US007287327B2

(12) United States Patent
Ito et al.

(10) Patent No.: US 7,287,327 B2
(45) Date of Patent: Oct. 30, 2007

(54) ELECTRET CAPACITOR MICROPHONE AND METHOD FOR PRODUCING THE SAME

(75) Inventors: Motoaki Ito, Shizuoka (JP); Kentaro Yonehara, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 860 days.

(21) Appl. No.: 10/321,552

(22) Filed: Dec. 18, 2002

(65) Prior Publication Data

US 2003/0123682 A1 Jul. 3, 2003

(30) Foreign Application Priority Data

Dec. 28, 2001 (JP) ..... P. 2001-399737

(51) Int. Cl.
*H04R 19/01* (2006.01)
*H04R 31/00* (2006.01)

(52) U.S. Cl. ..... 29/886; 29/594; 181/158; 381/191

(58) Field of Classification Search ..... 29/594, 29/609.1, 595, 25.35, 886; 181/158, 167; 381/174, 191
See application file for complete search history.

(56) References Cited

U.S. PATENT DOCUMENTS 3,247,927 A * 4/1966 Cragg ..... 181/168
3,337,665 A * 8/1967 Underwood et al. ..... 264/567

FOREIGN PATENT DOCUMENTS

JP 2000-032596 1/2000

* cited by examiner

*Primary Examiner*—A. Dexter Tugbang
*Assistant Examiner*—Livius R. Cazan
(74) *Attorney, Agent, or Firm*—Sughrue Mion, PLLC

(57) ABSTRACT

A method for producing an electret capacitor microphone high in sensitivity and stable in acoustic characteristic. A PET film stretched with predetermined tension is bonded to a diaphragm support ring to perform stretch and fixation of a diaphragm to produce a diaphragm sub-assembly. The diaphragm sub-assembly is heated at a predetermined temperature (e.g. 200° C.) higher than a second order transition point of PET. Then, the diaphragm sub-assembly is packed in a housing. Because the diaphragm sub-assembly is heated at the predetermined temperature before packed in the housing, the stiffness of the diaphragm is reduced. Because the stiffness of the diaphragm 26 is reduced in such a manner, the tension at the time of stretch and fixation of the diaphragm can be set to a large value to prevent the diaphragm from being crinkled.

8 Claims, 7 Drawing Sheets

ELECTRET CAPACITOR MICROPHONE AND METHOD FOR PRODUCING THE SAME

BACKGROUND OF THE INVENTION

1. Field of the Invention

The present invention relates to an electret capacitor microphone and a method for producing the same.

2. Background Art

Generally, in a process for producing an electret capacitor microphone, for example, as described in Japanese Patent Laid-Open No. 2000-32596, a diaphragm is stretched on and fixed to a diaphragm support ring to produce a diaphragm sub-assembly. A housing is then packed with the diaphragm sub-assembly together with other parts such as a back plate.

As described in this official gazette, a diaphragm made of a thermoplastic resin such as PET (polyethylene terephthalate) is frequently used as the diaphragm in the electret capacitor microphone. A thermoplastic resin film is stretched with predetermined tension and then bonded to a diaphragm support ring.

In the related-art electret capacitor microphone and the method for producing the same, there is however the following problem.

If too large tension is applied on the thermoplastic resin film when the diaphragm is fixed to the diaphragm support ring, the stiffness of the diaphragm becomes too high to sufficiently increase microphone sensitivity. Particularly it is difficult to increase microphone sensitivity in a small-size electret capacitor microphone because the size of the diaphragm is so small that the stiffness of the diaphragm becomes very high even in the case where the applied tension is not changed.

On the other hand, if the tension at the time of stretch and fixation of the diaphragm is set to a small value, the stiffness of the diaphragm can be reduced. The diaphragm is, however, easily crinkled if the tension becomes too small. For this reason, acoustic characteristic of the microphone becomes unstable. Particularly because the supply of the thermoplastic resin film is generally performed by feeding the film out of a film roll, the diaphragm is easily crinkled even in the case where the tension is slightly reduced.

SUMMARY OF THE INVENTION

The invention is accomplished in consideration of such circumstances and an objective of the invention is to provide an electret capacitor microphone and a method for producing the same, in which an electret capacitor microphone high in sensitivity and stable in acoustic characteristic can be obtained.

The invention is provided to achieve the foregoing objective by applying a predetermined heating process at the stage of a diaphragm sub-assembly.

The invention provides a method of producing an electret capacitor microphone, wherein the electret capacitor microphone includes a diaphragm sub-assembly having a diaphragm fixed to a diaphragm support member, and a housing for packing the diaphragm sub-assembly. The method includes:

fixing a thermoplastic resin film stretched with predetermined tension on the diaphragm support member to produce the diaphragm sub-assembly;

heating the diaphragm sub-assembly at a predetermined temperature higher than a second order transition point of thermoplastic resin constituting the diaphragm; and packing the diaphragm sub-assembly in the housing.

The invention also provides an electret capacitor microphone including:

a diaphragm sub-assembly including a diaphragm and a diaphragm support member, the diaphragm made of thermoplastic resin being stretched and fixed to the diaphragm support member; and a housing packed with the diaphragm sub-assembly;

wherein the diaphragm sub-assembly is heat-treated at a predetermined temperature higher than a second order transition point of the thermoplastic resin and then packed in the housing.

A specific fixation method used for "fixing a thermoplastic resin film stretched with predetermined tension on the diaphragm support member" in the configuration is not particularly limited. For example, adhesive bonding, welding, or contact bonding may be used.

The "diaphragm support member" as to the specific shape thereof, etc. is not particularly limited if it is formed so that the diaphragm can be stretched and fixed.

The "predetermined temperature" as to the specific value thereof is not particularly limited if it is higher than the second order transition point of the thermoplastic resin constituting the diaphragm. It is however preferable that the diaphragm sub-assembly is heated to a temperature somewhat near the melting point of the thermoplastic resin.

The "thermoplastic resin constituting the diaphragm" as to the kind thereof is not particularly limited. For example, PET, PPS (polyphenylene sulfide), and PEI (polyetherimide) may be used.

According to the configuration, a thermoplastic resin film stretched with predetermined tension is fixed to a diaphragm support member. Thus, stretch and fixation of the diaphragm are performed. It becomes obvious from a result of the inventors' experiment that the stiffness of the diaphragm is reduced when the diaphragm sub-assembly produced by the stretch and fixation of the diaphragm is heated at a predetermined temperature higher than the second order transition point of the thermoplastic resin constituting the diaphragm.

Therefore, when the diaphragm sub-assembly is heated at the predetermined temperature before the diaphragm sub-assembly is packed in a housing, the stiffness of the diaphragm can be reduced to thereby make microphone sensitivity high. Moreover, because the stiffness of the diaphragm can be reduced by the heating treatment after the stretch and fixation, the tension at the time of stretch and fixation can be set to a large value to prevent the diaphragm from being crinkled.

If the heating treatment is carried out after assembling of the electret capacitor microphone is completed, electric charge accumulated in an electret disappears or decreases when the heating time is extended to a certain degree. In this invention, however, the heating treatment is carried out before the diaphragm sub-assembly is packed in the housing. Hence, even in the case where the heating time is set to be long, there is no fear of bad influence on other constituent parts of the electret capacitor microphone.

Hence, according to the invention, it is possible to obtain an electret capacitor microphone high in sensitivity and stable in acoustic characteristic.

In the configuration, the time required for heating the diaphragm sub-assembly is not particularly limited. When, for example, the heating treatment is carried out for a time period of not shorter than 1 hour, the stiffness of the diaphragm can be reduced sufficiently. It is also preferable from the point of view of sufficient reduction in the stiffness of the diaphragm that the temperature for heating the diaphragm sub-assembly is set at a temperature somewhat near the melting point of the thermoplastic resin.

In the configuration, when the diaphragm sub-assembly and the housing are heated at a temperature lower than the predetermined temperature after the diaphragm sub-assembly is packed in the housing, internal distortion of constituent parts of the electret capacitor microphone can be removed to thereby stabilize the acoustic characteristic more greatly. If the temperature for heating in this case is lower than the predetermined temperature, the temperature for heating is not particularly limited but can be set suitably in accordance with the heating time. When, for example, the heating treatment is carried out at a temperature of about 60° C. to about 80° C. for about one hour, the internal distortion can be removed without giving any influence on the functions of the constituent parts.

It becomes obvious from a result of the inventors' experiment that when PPS is used as the material of the diaphragm, the stiffness of the diaphragm can be kept substantially equal to a value reduced by the first heating treatment even in the case where the heating treatment is carried out at the predetermined temperature again after the heating treatment is carried out at the predetermined temperature. Therefore, when a PPS film is used as the "thermoplastic resin film", microphone sensitivity can be prevented from changing even in the case where the electret capacitor microphone will be put into a reflow furnace or the like and subjected to a high-temperature short-time heating treatment in the future.

Further, the electret capacitor microphone according to the invention is provided with a diaphragm sub-assembly having a diaphragm of a thermoplastic resin stretched on and fixed to a diaphragm support member. Because the diaphragm sub-assembly is packed in the housing after heated at a predetermined temperature higher than a second order transition point of the thermoplastic resin constituting the diaphragm, the stiffness of the diaphragm can be reduced to thereby make microphone sensitivity high.

On this occasion, when PPS is used as the thermoplastic resin constituting the "diaphragm", microphone sensitivity can be prevented from changing even in the case where the electret capacitor microphone will be put into a reflow furnace or the like and subjected to a high-temperature short-time heating treatment in the future.

DETAILED DESCRIPTION OF THE PREFERRED EMBODIMENTS

An embodiment of the invention will be described below with reference to the drawings.

Figure 1:
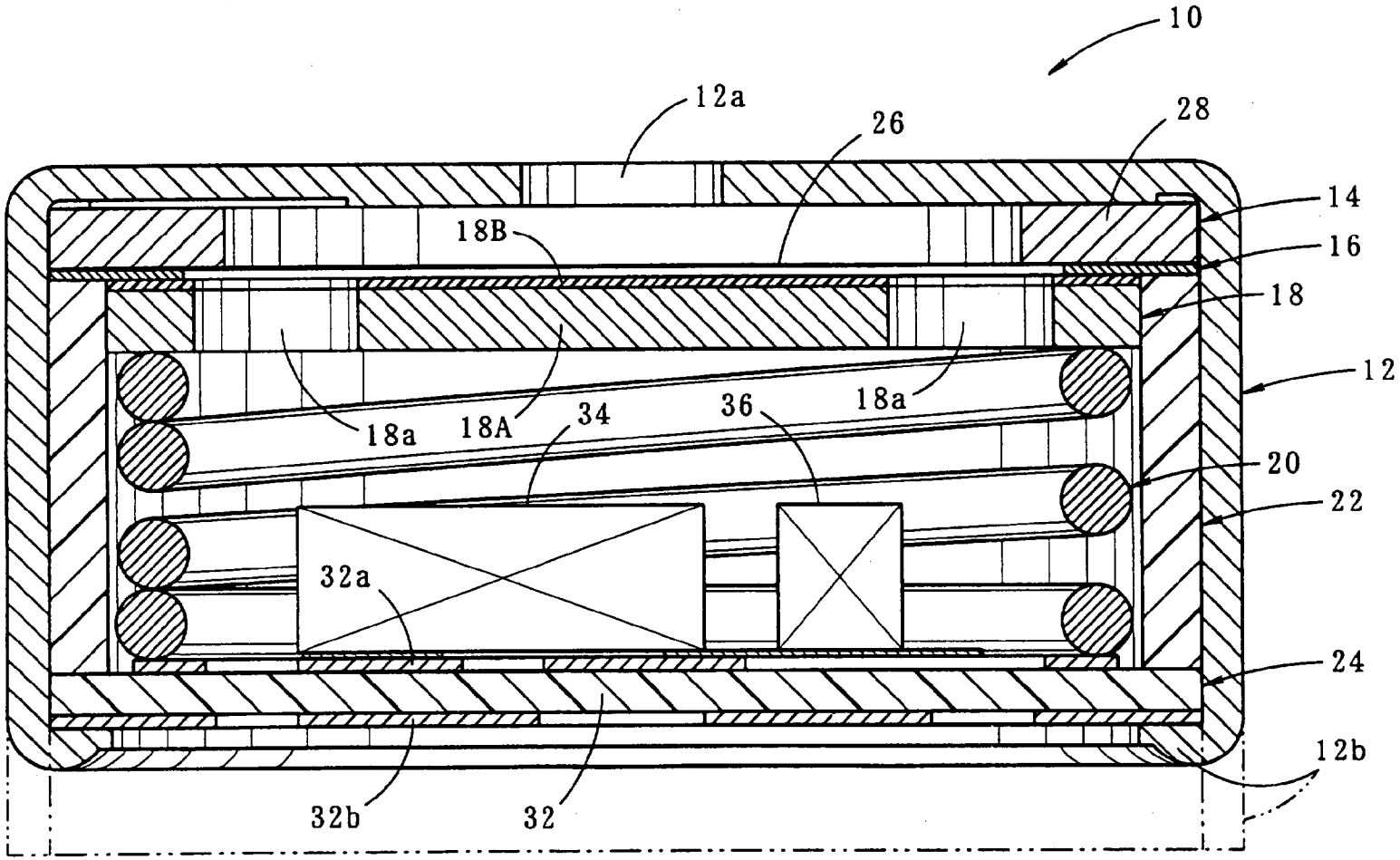
FIG. 1 is a side sectional view showing an electret capacitor microphone facing upward as a subject of application of a producing method according to an embodiment of the invention.

FIG. 1 is a side sectional view showing an electret capacitor microphone facing upward as a subject of application of a producing method according to an embodiment of the invention.

As shown in FIG. 1, the electret capacitor microphone 10 according to this embodiment is a small-size microphone which is about 3 mm in outer diameter and which has a cylindrical housing 12. A diaphragm sub-assembly 14, a spacer 16, a back plate 18, a coiled spring 20, an electrically insulating bush 22 and an FET board 24 are packed in the housing 12.

The housing 12 has a sound hole 12*a* formed in its upper end wall, and an opening lower end portion 12*b* caulked and fixed to the FET board 24.

Figures 2A, 2B:
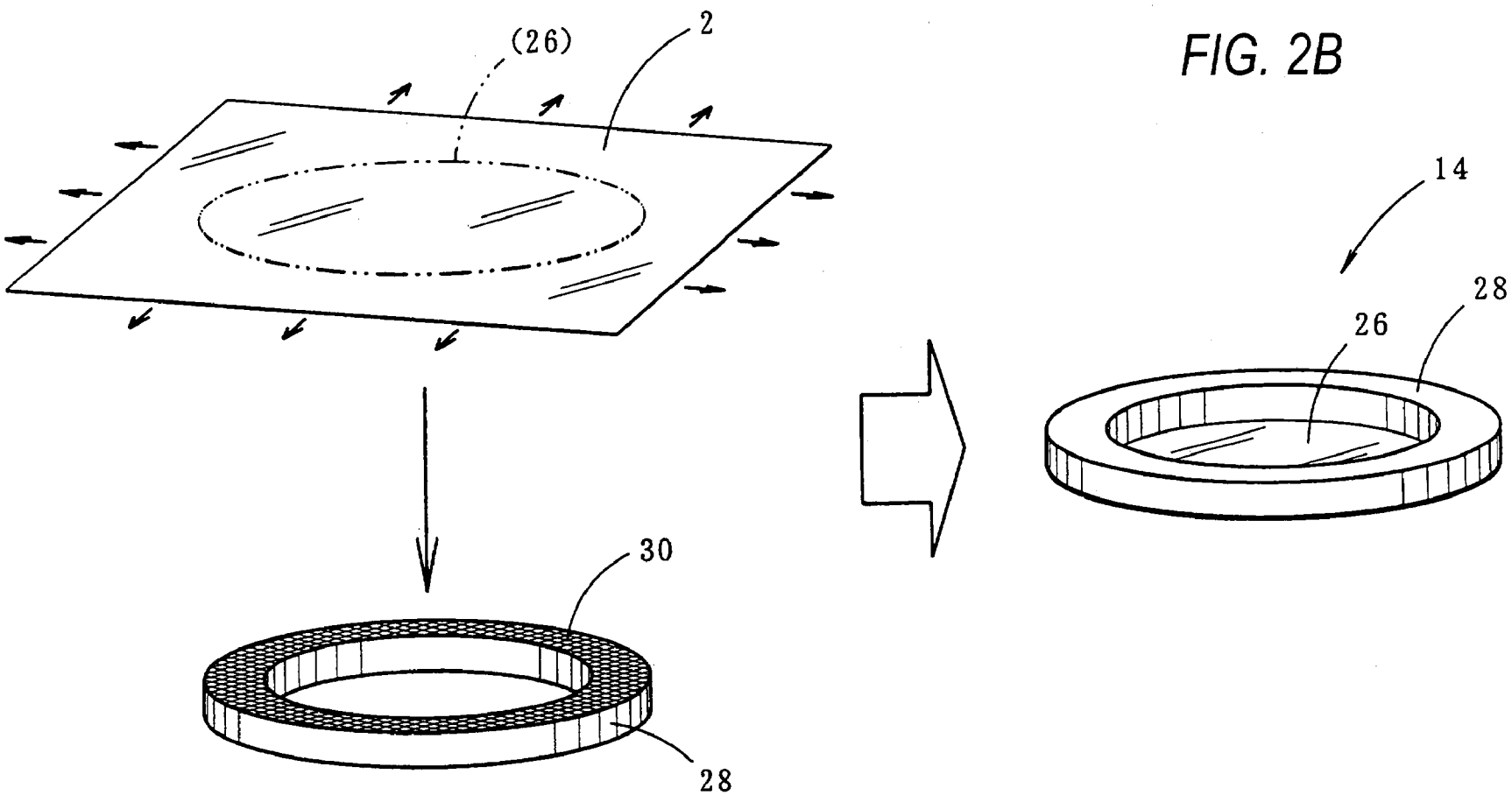
FIG. 2A is a perspective view showing a state in which a diaphragm is stretched on and fixed to a diaphragm support ring in the producing method.
FIG. 2B is a perspective view showing the diaphragm sub-assembly produced by the stretch and fixation as a single part.

FIG. 2B shows the diaphragm sub-assembly 14 as a single part. As shown in FIG. 2B, the diaphragm sub-assembly 14 has a diaphragm 26 stretched on and fixed to a diaphragm support ring 28 (diaphragm support member). The diaphragm 26 has a circular PET film about 1.5 μm thick, and a vapor deposition film of a metal such as nickel formed on an upper surface of the circular PET film. The outer diameter of the diaphragm 26 is set to be substantially equal to the inner diameter of the housing 12. On the other hand, the diaphragm support ring 28 is made of a metal and has an outer diameter substantially equal to the outer diameter of the diaphragm 26.

The stretch and fixation of the diaphragm 26 to the diaphragm support ring 28 is performed as shown in FIG. 2A. That is, in the condition that the PET film 2 (thermoplastic resin film) having the metal vapor deposition film formed on its lower surface is stretched with predetermined tension by the weight of a jig not shown, the PET film 2 is pressed against the diaphragm support ring 28 having an adhesive agent 30 applied on its upper surface. As a result, the PET film 2 is bonded to the diaphragm support ring 28 through the adhesive agent 30. Then, an unnecessary portion of the PET film 2 is removed. In this manner, the stretch and fixation of the diaphragm 26 is completed.

The spacer 16 is constituted by a thin-plate ring of stainless steel having an outer diameter substantially equal to the inner diameter of the housing 12.

The back plate 18 has a back plate body 18A, and an electret 18B thermally fusion-bonded (laminated) onto an upper surface of the back plate body 18A. A plurality of through-holes 18*a* are formed in the back plate 18.

The back plate body 18A is made of a stainless steel plate about 0.15 mm thick. The electret 18B is made of an FEP film about 25 μm thick. A polarizing treatment is applied to the electret 18B so that a predetermined surface potential (e.g. about −260 V) can be obtained.

In the housing 12, the electret 18B and the diaphragm 26 are opposite to each other with separation of a predetermined small distance through the spacer 16 to thereby form a capacitor portion.

The electrically insulating bush 22 is a cylindrical member which has an outer diameter substantially equal to the inner diameter of the housing 12. The back plate 18 and the coiled spring 20 are disposed on the inner circumferential side of the electrically insulating bush 22. On this occasion, the back plate 18 is elastically pressed by the coiled spring 20 so as to be urged toward the spacer 16.

The FET board 24 has a circular board body 32, an FET chip 34, and a capacitor chip 36. Electrically conducting patterns 32*a* and 32*b* are formed on upper and lower surfaces of the circular board body 32. The FET chip 34 and the capacitor chip 36 are mounted on the upper surface of the circular board body 32. The board body 32 has an outer diameter substantially equal to the inner diameter of the housing 12. The board body 32 abuts on the electrically insulating bush 22 at its outer circumferential edge portion.

The operation and effect of this embodiment will be described below.

The electret capacitor microphone 10 according to this embodiment is assembled as follows. The diaphragm sub-assembly 14, the spacer 16, the electrically insulating bush 22, the back plate 18, the coiled spring 20 and the FET board 24 are incorporated in this order in the housing 12 (represented by the chain double-dashed line in FIG. 1) which has not been caulked and fixed yet. Then, the opening lower end portion 12*b* of the housing 12 is caulked and fixed to the FET board 24. In this manner, the assembling of the electret capacitor microphone 10 is completed.

In this embodiment, at a stage before the diaphragm sub-assembly 14 and the other parts are incorporated in the housing 12, the diaphragm sub-assembly 14 is heated at a predetermined temperature (e.g. 200° C. somewhat near the melting point (265° C.) of PET) higher than the second order transition point (69° C.) of PET constituting the diaphragm 26 for a predetermined time (e.g. 1 hour) to thereby reduce the stiffness of the diaphragm 26.

This is based on the fact that it becomes clear from results of a series of inventors' experiments that the stiffness of the diaphragm 26 is reduced when the diaphragm sub-assembly 14 is heated at a predetermined temperature higher than the second order transition point of PET constituting the diaphragm 26.

Figure 3:
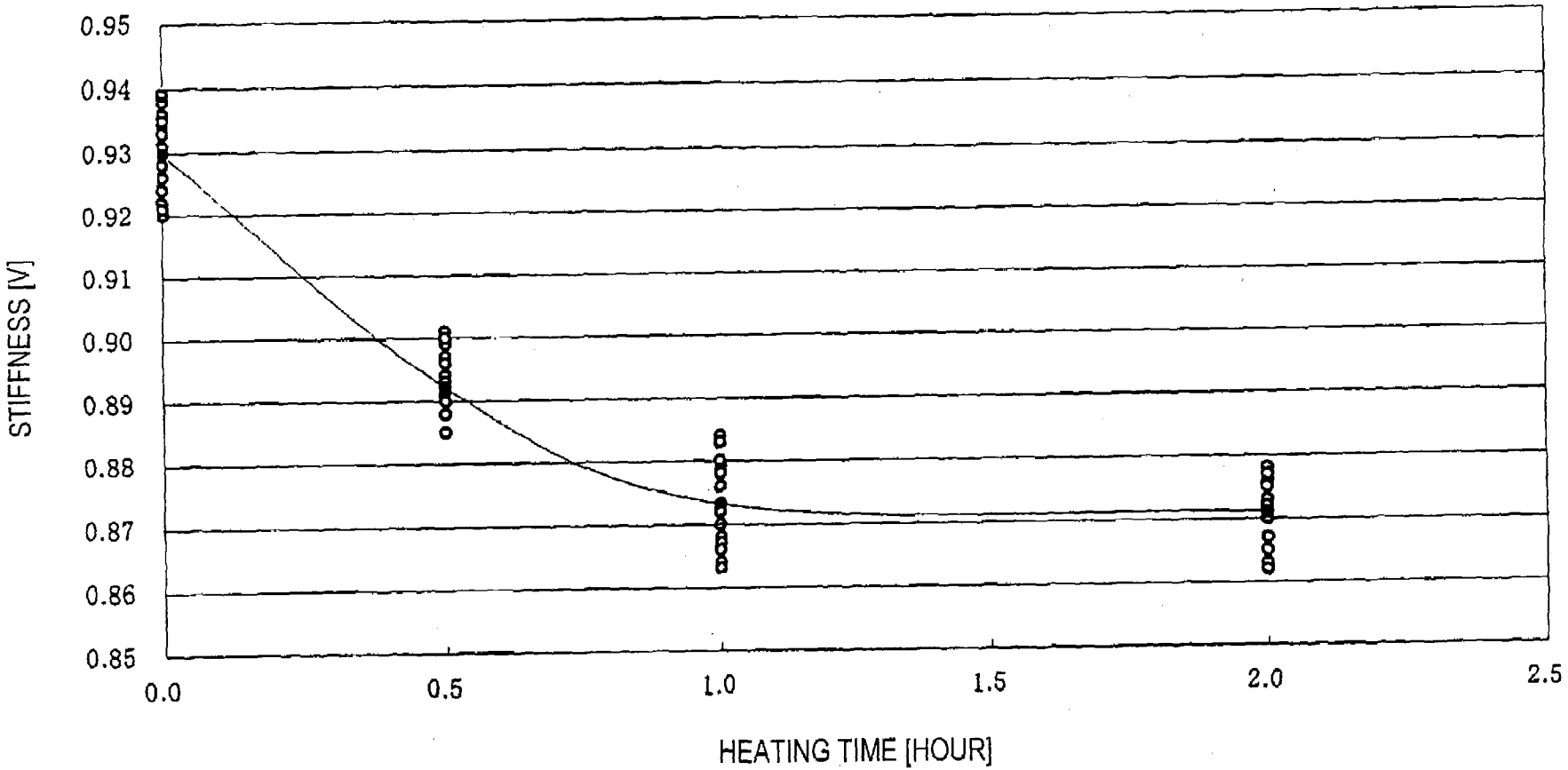
FIG. 3 is a graph showing results of an experiment for examining the relation between the time required for heating the diaphragm sub-assembly and the stiffness of the diaphragm (made of PET).

FIG. 3 is a graph showing results of an experiment for examining the relation between the time required for heating the diaphragm sub-assembly 14 and the stiffness of the diaphragm 26.

Each of samples of the diaphragm sub-assembly 14 used in this experiment was prepared as follows. A PET film 2 (a combination of a 1.5 μm-thick PET film and a nickel vapor deposition film formed on the PET film) stretched with tension of 2 kgf by the weight of a jig was bonded to a Φ3 mm diaphragm support ring 28 to thereby perform stretch and fixation of a diaphragm 26. The temperature used for heating the diaphragm sub-assembly 14 was 200° C. The heating treatment was performed in such a manner that each sample was put into an oven and left in the oven. Incidentally, the stiffness (V) expressed by the vertical axis in the graph of FIG. 3 is a relative value when the stiffness of a rigid body is regarded as a reference value of 1 (V).

As shown in FIG. 3, it is obvious that the stiffness of the diaphragm 26 is reduced rapidly when the diaphragm sub-assembly 14 is heated, and that the stiffness is stabilized in a state in which the stiffness is reduced greatly (by 5% or more) after 1 hour or longer.

Figure 4:
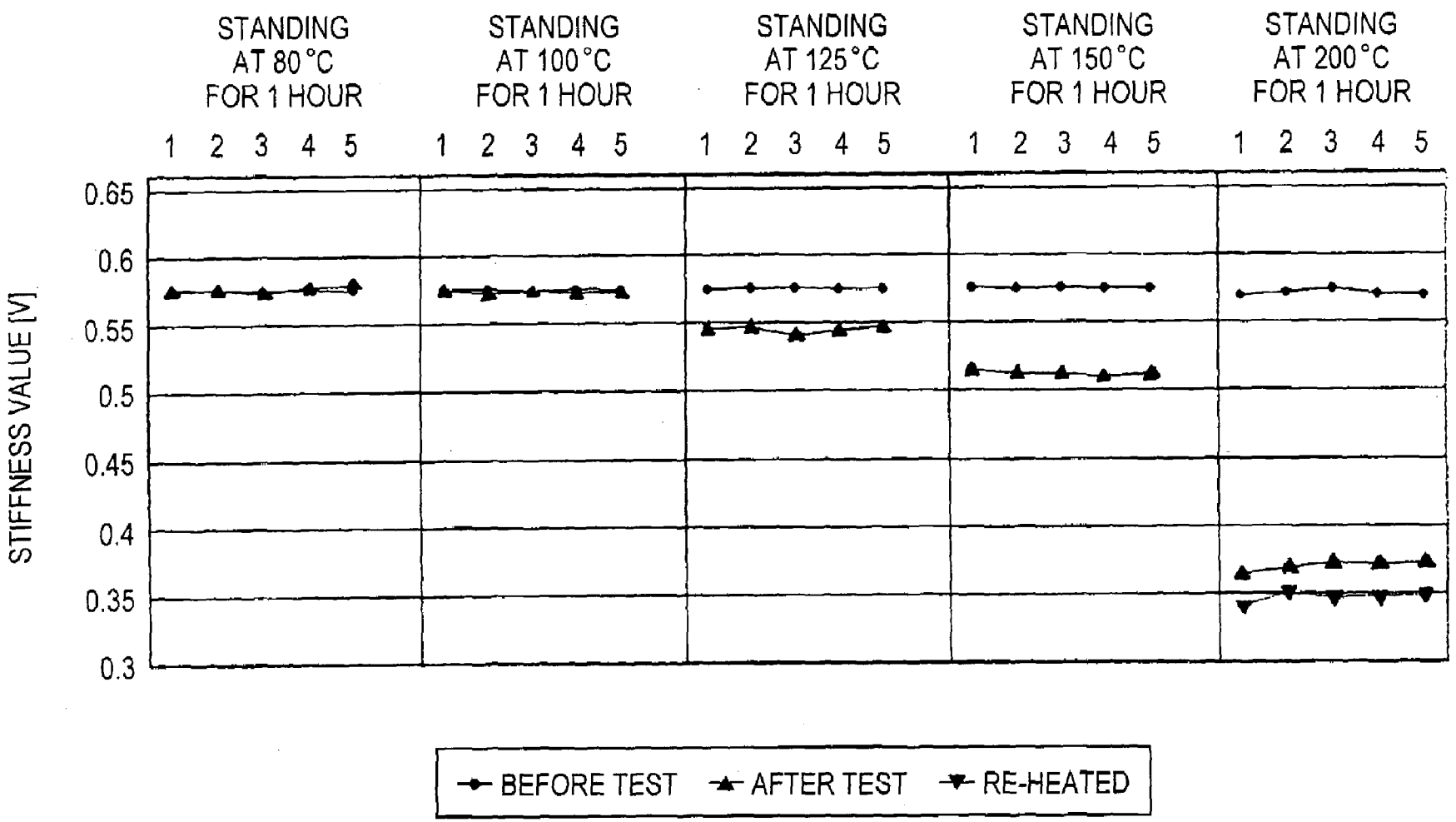
FIG. 4 is a graph showing results of an experiment for examining the relation between the temperature used for heating the diaphragm sub-assembly and the stiffness of the diaphragm (made of PET).

FIG. 4 is a graph showing results of an experiment for examining the relation between the temperature used for heating the diaphragm sub-assembly 14 and the stiffness of the diaphragm 26.

Each of samples of the diaphragm sub-assembly 14 used in this experiment was prepared as follows. A PET film 2 (a combination of a 1.5 μm-thick PET film and a nickel vapor deposition film formed on the PET film) stretched with the same tension was bonded to a Φ9 mm diaphragm support ring 28 to thereby perform stretch and fixation of a diaphragm 26. The time required for heating the diaphragm sub-assembly 14 was 1 hour.

As shown in FIG. 4, it is obvious that the stiffness of the diaphragm 26 is reduced gradually in accordance with the increase in the temperature for heating the diaphragm sub-assembly 14 when the diaphragm sub-assembly 14 is heated at a temperature higher than 100° C., and that the stiffness is considerably reduced when the temperature reaches 200° C. Incidentally, the stiffness value in the graph shown in FIG. 4 is relatively small compared with that in the graph shown in FIG. 3 because samples larger in the diameter of the diaphragm 26 are used in FIG. 4.

Figure 5:
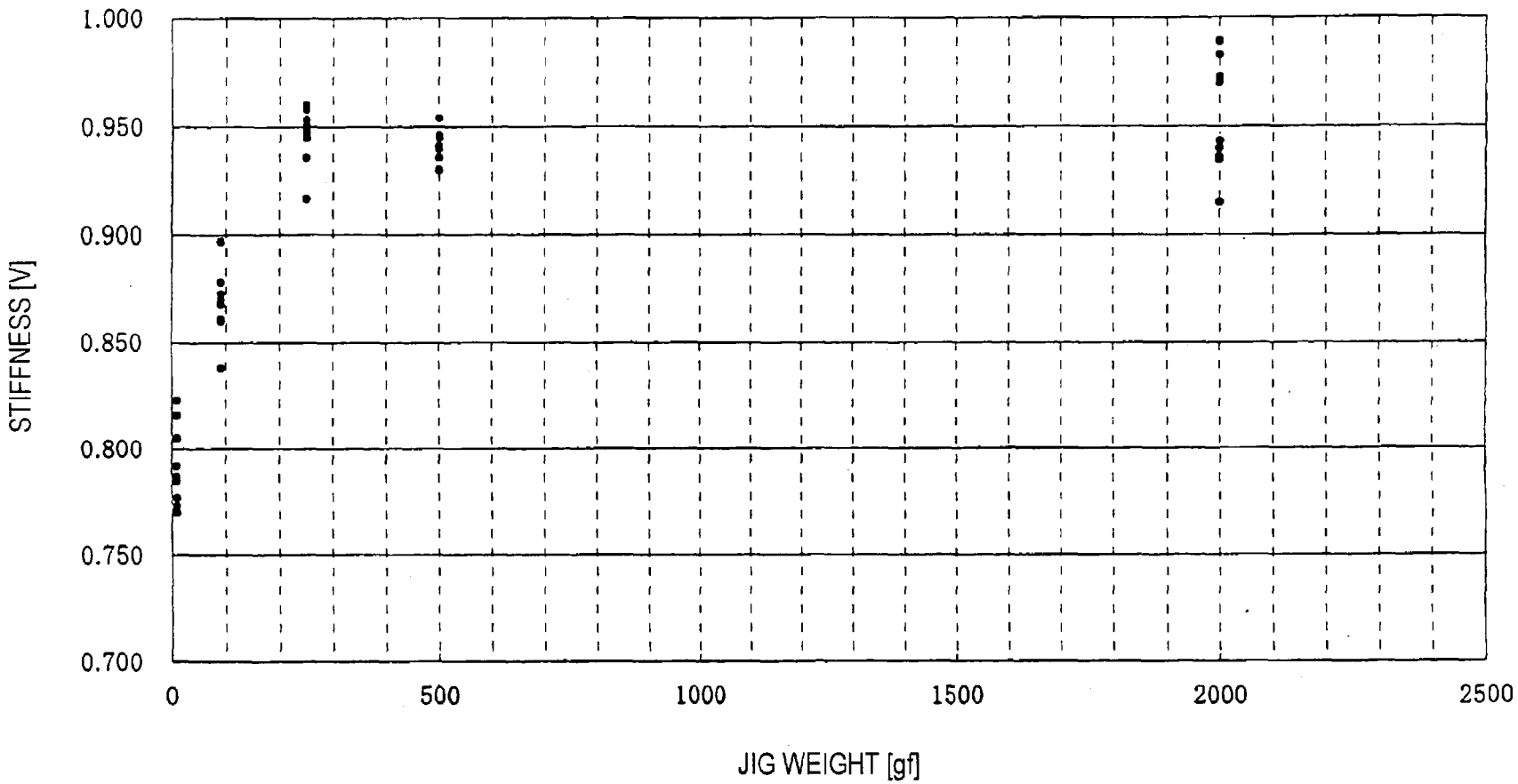
FIG. 5 is a graph showing results of an experiment for examining the relation between the weight of a jig used at the time of stretch and fixation and the stiffness of the diaphragm (made of PET).

FIG. 5 is a graph showing results of an experiment for examining the relation between the weight of a jig used at the time of stretch and fixation and the stiffness of the diaphragm 26 in the diaphragm sub-assembly 14 produced by the stretch and fixation.

Each of samples of the diaphragm sub-assembly 14 used in this experiment was prepared as follows. A PET film 2 (a combination of a 1.5 μm-thick PET film and a nickel vapor deposition film formed on the PET film) was bonded to a Φ3 mm diaphragm support ring 28 to thereby perform stretch and fixation of a diaphragm 26.

As shown in FIG. 5, it is obvious that the stiffness of the diaphragm 26 is stable in a relatively large value when the jig weight increases to 250 gf or larger (that is, when relatively high tension is given), and that the stiffness of the diaphragm 26 is reduced rapidly when the jig weight decreases to 250 gf or smaller.

According to the results of this experiment, it may be also conceived that the stiffness of the diaphragm 26 can be reduced when the jig weight is selected to take a somewhat small value. In this case, tension at the time of stretch and fixation, however, becomes small. For this reason, the diaphragm 26 is easily crinkled, so that acoustic characteristic of the microphone becomes unstable.

By contrast, as in this embodiment, since the diaphragm sub-assembly 14 is heated at the predetermined temperature before the diaphragm sub-assembly 14 is packed in the housing 12, the stiffness of the diaphragm 26 can be reduced to thereby make microphone sensitivity high. Moreover, because the stiffness of the diaphragm 26 can be reduced by the heating treatment after the stretch and fixation, the tension at the time of stretch and fixation can be selected to take a large value. As a result, the diaphragm 26 can be prevented from being crinkled.

If the heating treatment is performed after assembling of the electret capacitor microphone 10 is completed, electric charge accumulated in the electret 18B disappears or decreases when the time used for the heating treatment becomes somewhat long (specifically, e.g. 30 minutes or longer at 200° C.). In this embodiment, because the heating treatment is performed before the diaphragm sub-assembly 14 is packed in the housing 12, there is no fear of bad influence on other constituent parts of the electret capacitor microphone 10 even in the case where the heating time is selected to be long.

According to this embodiment, it is hence possible to obtain an electret capacitor microphone high in sensitivity and stable in acoustic characteristic.

As is obvious from the results of the experiment shown in FIG. 4, the stiffness of the diaphragm 26 can be reduced when the temperature used for heating the diaphragm sub-assembly 14 is selected to be higher than 100° C. The stiffness of the diaphragm 26 can be reliably reduced when the diaphragm sub-assembly 14 is heated at a temperature of about 200° C. somewhat near the melting point (265° C.) of PET.

In the producing method according to this embodiment, when the electret capacitor microphone 10 is heated at a temperature lower than the predetermined temperature after assembling of the electret capacitor microphone 10 is completed, internal distortion of constituent parts of the electret capacitor microphone 10 can be removed to thereby stabilize acoustic characteristic more greatly. Specifically, when, for example, the electret capacitor microphone 10 is heated at a temperature of about 60° C. to about 80° C. for about one hour, the internal distortion of the constituent parts of the electret capacitor microphone 10 can be removed without giving any bad influence on the functions of the constituent parts.

Although this embodiment has been described upon the case where a PET film is used for performing stretch and fixation of the diaphragm 26 when the diaphragm sub-assembly 14 is produced, the invention may be applied also to the case where any other thermoplastic resin film (such as a PPS film) than the PET film is used.

Figure 6:
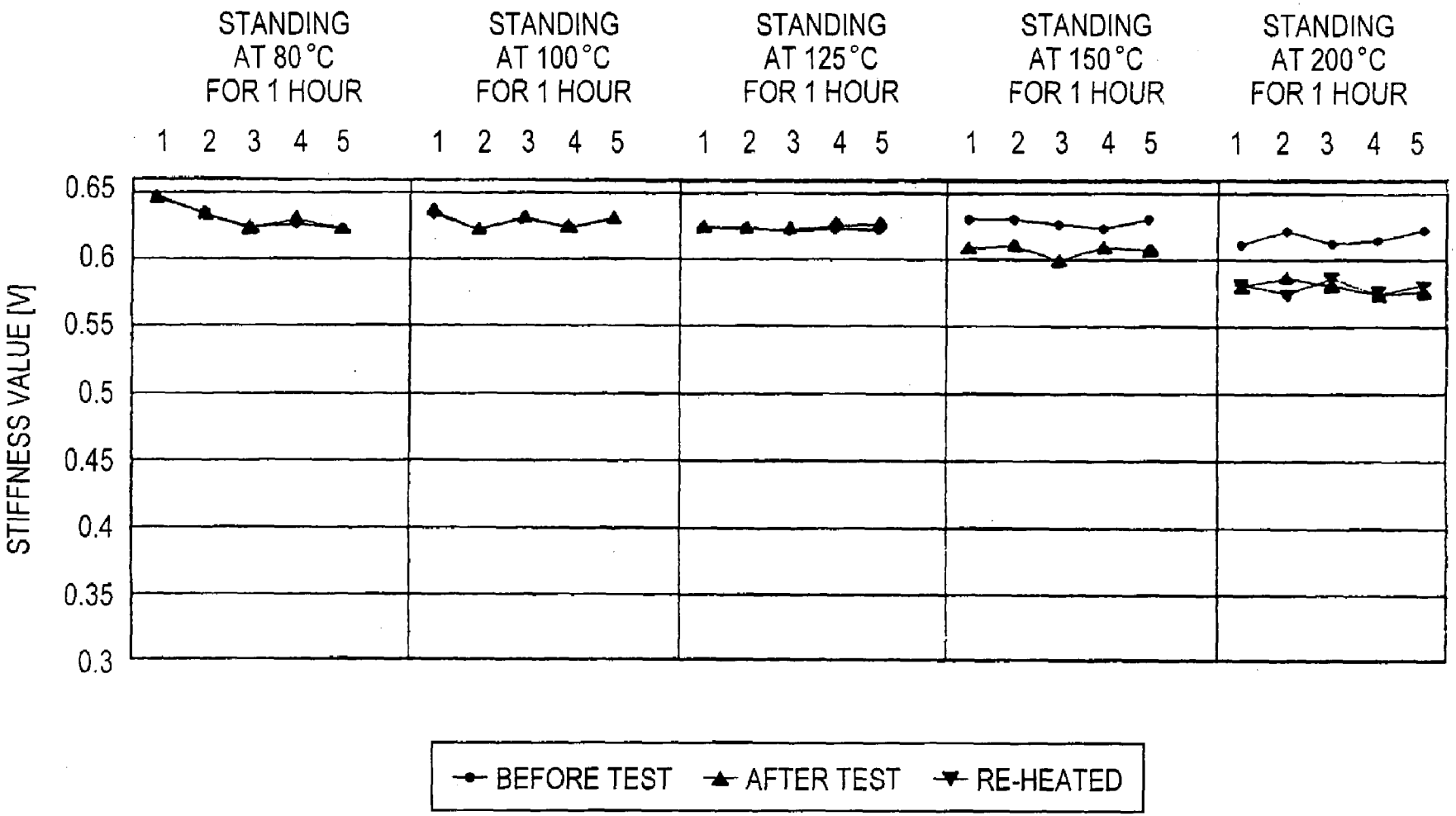
FIG. 6 is a graph showing results of an experiment for examining the relation between the temperature used for heating the diaphragm sub-assembly and the stiffness of the diaphragm (made of PPS).

FIG. 6 is a graph showing results of an experiment for examining the relation between the temperature used for heating the diaphragm sub-assembly 14 and the stiffness of the diaphragm 26 in the case where a PPS (polyphenylene sulfide) film is used for performing stretch and fixation of the diaphragm 26.

Each of samples of the diaphragm sub-assembly 14 used in this experiment was prepared as follows. A PPS film (a combination of a 1.5 μm-thick PPS film and a nickel vapor deposition film formed on the PPS film) stretched with the same tension was bonded to a Φ9 mm diaphragm support ring 28 to thereby perform stretch and fixation of a diaphragm 26. The time required for heating the diaphragm sub-assembly 14 was 1 hour.

As shown in FIG. 6, it is obvious that the stiffness of the diaphragm 26 is reduced gradually in accordance with the rise in the heating temperature when the diaphragm sub-assembly 14 is heated at a temperature higher than 125° C.

The quantity of reduction of the stiffness at 200° C. in the case where the PPS film is used is relatively small compared with the case where the PET film is used. In the case where the PPS film is used, it is however confirmed that the stiffness little changes after the first heating treatment at 200° C. even if the diaphragm sub-assembly 14 is re-heated at 200° C. That is, as represented by "re-heated" in the graphs shown in FIGS. 4 and 6, the stiffness of the diaphragm 26 in the case of use of the PET film is slightly reduced when the diaphragm sub-assembly 14 is put into an oven and re-heated at 200° C. for 1 hour after the diaphragm sub-assembly 14 is once heated at 200° C., whereas the stiffness of the diaphragm 26 in the case of use of the PPS film little changes even in the same condition.

Figure 7:
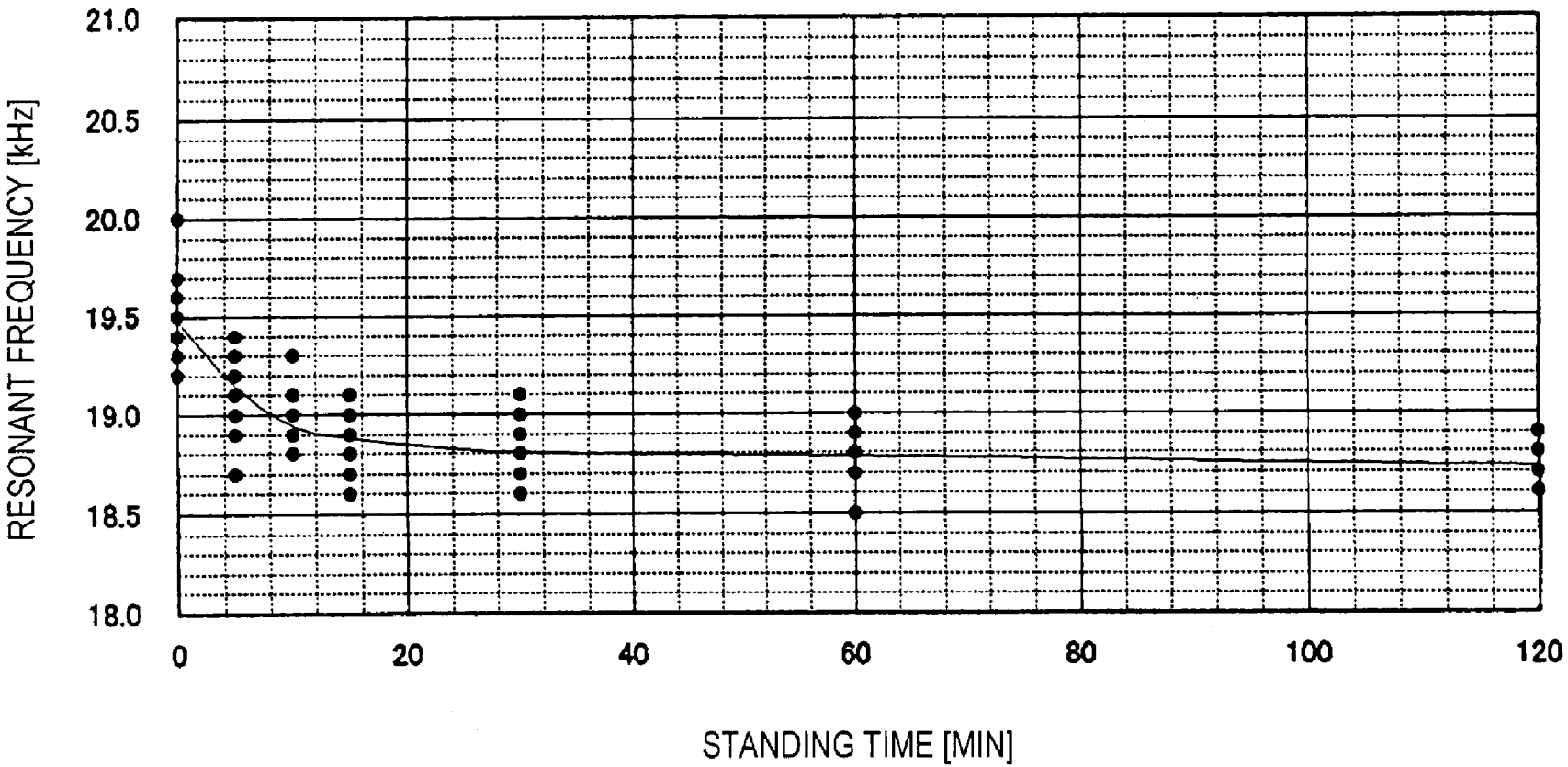
FIG. 7 is a graph showing results of an experiment for examining the relation between the time required for heating the diaphragm sub-assembly and the resonant frequency of the diaphragm (made of PPS).

FIG. 7 is a graph showing results of an experiment for examining the relation between the time required for heating the diaphragm sub-assembly 14 and the resonant frequency of the diaphragm 26.

Each of samples of the diaphragm sub-assembly 14 used in this experiment was prepared as follows. A PPS film (a combination of a 2 μm-thick PPS film and a nickel vapor deposition film formed on the PPS film) stretched with tension of 2 kgf by the weight of a jig was bonded to a Φ9 mm diaphragm support ring 28 to thereby perform stretch and fixation of a diaphragm 26. The temperature used for heating the diaphragm sub-assembly 14 was 200° C.

As shown in FIG. 7, when the diaphragm sub-assembly 14 is heated, the resonant frequency of the diaphragm 26 shifts to a low frequency band side rapidly with the reduction in stiffness of the diaphragm 26 but becomes considerably stable after 15 minutes or longer. It is also obvious that variation in resonant frequency of samples (n=20) at a point of time when 2 hours has passed is reduced to about a half compared with that at a point of time when the heating treatment starts.

In this manner, also in the case of use of the PPS film, when the diaphragm sub-assembly 14 is heated at a predetermined temperature (e.g. 200° C.) higher than the second order transition point (92° C.) of PPS constituting the diaphragm 26 before the diaphragm sub-assembly 14 is packed in the housing 12, the stiffness of the diaphragm 26 can be reduced to thereby make microphone sensitivity high. Moreover, because the stiffness of the diaphragm 26 can be reduced by the heating treatment after the stretch and fixation, the tension at the time of stretch and fixation can be selected to take a large value. As a result, the diaphragm 26 can be prevented from being crinkled.

Moreover, when the diaphragm sub-assembly 14 is once heated at the predetermined temperature in the case of use of the PPS film, the stiffness of the diaphragm 26 can be kept substantially equal to the value reduced by the first heating treatment even if the diaphragm sub-assembly 14 is re-heated at the same temperature. Hence, even if the electret capacitor microphone 10 is put into a reflow furnace or the like and heated at a high temperature for a short time (e.g. at 200° C. for 5 minutes) after assembling of the electret capacitor microphone 10 is completed, microphone sensitivity can be prevented from changing.

As is obvious also from the results of the experiment shown in FIG. 6, the stiffness of the diaphragm 26 can be reduced when the temperature used for heating the diaphragm sub-assembly 14 is selected to be higher than 125° C. Incidentally, the stiffness of the diaphragm 26 can be reduced surely when the diaphragm sub-assembly 14 is heated at a temperature of about 200° C. somewhat near the melting point (285° C.) of PPS.

What is claimed is:

1. A method of producing an electret capacitor microphone, wherein the electret capacitor microphone includes a diaphragm sub-assembly having a diaphragm fixed to a diaphragm support member, and a housing for packing the diaphragm sub-assembly, the method comprising:

fixing a thermoplastic resin film stretched with predetermined tension on the diaphragm support member to produce the diaphragm sub-assembly;

heating the diaphragm sub-assembly at a predetermined temperature that is lower than a melting point of the thermoplastic resin constituting the diaphragm, and higher than a second order transition point of the thermoplastic resin and higher than 150° C.;

reducing a stiffness of the diaphragm by 5% or more; and packing the diaphragm sub-assembly in the housing.

2. The method according to claim 1, wherein the step of heating is performed or a time period of not smaller than one hour.

3. The method according to claim 2, further comprising: heating the housing and the diaphragm sub-assembly packed therein at a temperature lower than the predetermined temperature.

4. The method according claim 3, wherein a polyphenylene sulfide film is used as the thermoplastic resin film.

5. The method according claim 2, wherein a polyphenylene sulfide film is used as the thermoplastic resin film.

6. The method the according to claim 1, further comprising:

heating housing and the diaphragm sub-assembly packed therein at a temperature lower than the predetermined temperature.

7. The method according claim 6, wherein a polyphenylene sulfide film is used as the thermoplastic resin film.

8. The method according claim 1, wherein a polyphenylene sulfide film is used as the thermoplastic resin film.

* * * * *